US005916321A

United States Patent [19]

Holmes et al.

[11] Patent Number: 5,916,321

[45] Date of Patent: Jun. 29, 1999

[54] ROD DRIVER GEAR FOR A TUBING EXPANDER

[75] Inventors: Charles F. Holmes, Tuscola; William E. Benner, Jr., Newman, both of Ill.

[73] Assignee: Tridan International, Inc., Danville, Ill.

[21] Appl. No.: 09/148,917

[22] Filed: Sep. 4, 1998

[51] Int. Cl.[6] ..... B21D 39/08

[52] U.S. Cl. ..... 72/316; 72/449; 29/727; 29/890.044

[58] Field of Search ..... 72/316, 318, 293, 72/393, 457, 449; 29/890.044, 727

[56] References Cited

U.S. PATENT DOCUMENTS

| | | | |
|---|---|---|---|
| 2,406,949 | 9/1946 | Huck | 72/449 |
| 3,789,648 | 2/1974 | Ames | 72/316 |
| 4,282,739 | 8/1981 | Hallenbeck et al. | 72/449 |
| 4,726,273 | 2/1988 | Miceli | 72/449 |
| 5,129,246 | 7/1992 | Strickland et al. | 72/316 |
| 5,673,665 | 10/1997 | Kim | 123/197.1 |
| 5,752,313 | 5/1998 | Gaffaney et al. | 29/727 |

*Primary Examiner*—David Jones
*Attorney, Agent, or Firm*—Woodard, Emhardt, Naughton, Moriarty & McNett

[57] ABSTRACT

A rod driver gear for a tubing expander is operable to drive a rod having a circumferentially extending outer surface with a plurality of grooves extending traversely across a longitudinal axis of the rod. The rod driver gear includes an annular body rotatably mounted to a frame of the tubing expander and connected to a power source of the tubing expander. The annular body has a ridged outer diameter surface. Each ridge of the outer diameter surface is dimensioned to extend into the grooves of the rod to sequentially engage the grooves of the rods when the power source rotates the annular body to thereby move the rod along the longitudinal axis of the rod. In a preferred embodiment, the outer diameter surface of the annular body has a plurality of grooves extending across the surface, and a plurality of pins are inserted through a bore into the grooves. A portion of the pins extends from the grooves to constitute the ridges. In an alternative embodiment, the grooves are disposed within the outer diameter surface to constitute the ridges.

10 Claims, 7 Drawing Sheets

ROD DRIVER GEAR FOR A TUBING EXPANDER

BACKGROUND OF THE INVENTION

1. Field of the Invention

The present invention relates to the field of tube expanders.

2. Background

For heat exchangers and other similar devices, fins are mounted to tubes to provide an efficient means for transferring heat either to or from a medium circulated within the tubes while air or other gas is passed over the fins. Typically, the fins are fitted onto the tubes and subsequently expanded to create a secure mechanical bond between the fins and the tubes. It is desirable to expand the tubes to a larger outside diameter than the inside diameter of the fin holes receiving the tubes to produce a very tight mechanical bond between the fins and the tubes. A known tube expander for achieving such an outer diameter expansion of the tubes is disclosed in U.S. Pat. No. 3,789,648 to Ames. The tube expander of U.S. Pat. No. 3,789,648 includes a pair of oppositely turning rod driver gears coupled by gears to a hydraulic motor to longitudinally drive a rounded end of the rod into and out of the tubes. The driving of the rod by the wheels is achieved by a friction and/or pressure fit of a smooth outer diameter surface of each rod driver gear in contact with a periphery of the rod. A problem associated with a friction and/or pressure fit is the wear and tear on the rod by the rod driver gears that can significantly reduce the useable life of the rod. Another problem associated with a friction and/or pressure fit is the rod must be significantly hardened to minimize the potentiality of the rod breaking as the rod driver gears are driving the rounded end of the rod into and out of the tubes.

It is also known to positively drive the expander rod by forming a rack on the top surface thereof and a rack on the bottom surface thereof, and then drivingly engaging the rack teeth with a pair of oppositely driven pinion gears placed adjacent the top rack and the bottom rack. A typical rack and pinion arrangement is shown in U.S. Pat. No. 5,673,665.

SUMMARY OF THE INVENTION

The present invention provides a new and unique rod driver gear for a tubing expander. The rod driver gear overcomes the aforementioned drawbacks associated with the utilization of a pair of oppositely turning rod driver gears having a smooth outer diameter surface to longitudinally drive a rounded end of a rod into and out of tubes.

As shown in the following description of the preferred embodiment, a rod driver gear is operable to drive a rod having a circumferentially extending outer surface with a plurality of grooves extending traversely across a longitudinal axis of the rod. The rod driver gear is rotatably mounted to a frame and connected to a power source to be rotated. The rod driver gear includes an annular body having a ridged outer diameter surface. Each ridge of the outer diameter surface is dimensioned to extend into the grooves of the rod to sequentially engage the grooves of the rods when the power source rotates the rod driver to thereby move the rod along the longitudinal axis of the rod.

It is an object of the present invention to provide a rod driver gear for driving a rod into and out of a tube without wearing or tearing the rod.

It is another object of the present invention to provide a rod driver gear for driving a rod into and out of a tube without breaking or cracking the rod.

These and other objects and advantages of the present invention will become more apparent from a review of the following description of the preferred and alternative embodiments.

DESCRIPTION OF THE PREFERRED EMBODIMENT

Figure 1:
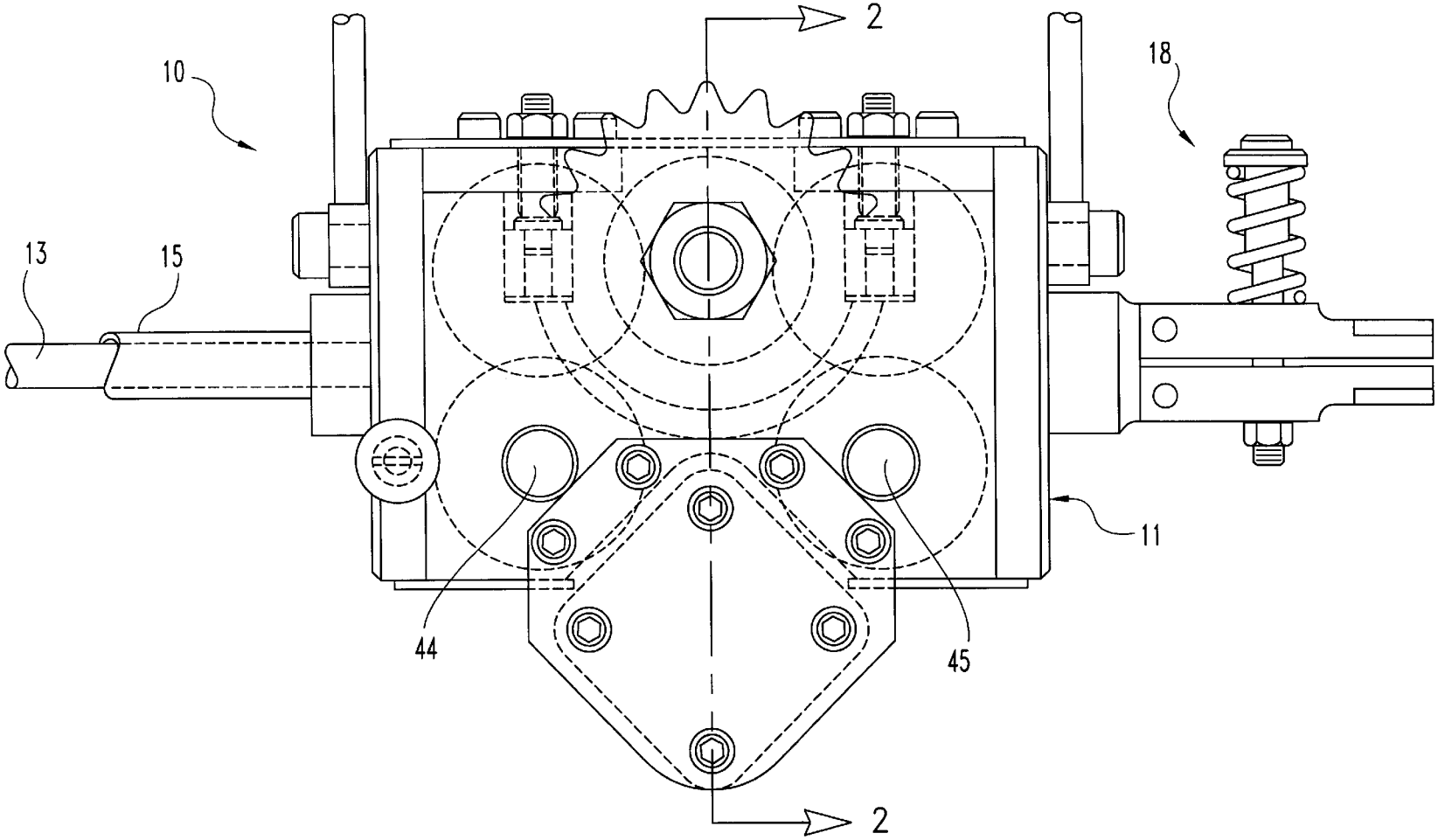
FIG. 1 is a side view of a preferred embodiment of a tube expander in accordance with the present invention.

For the purposes of promoting an understanding of the principles of the present invention, reference will now be made to the preferred and alternative embodiments of the present invention as illustrated in the drawings and specific language will be used to describe the same. It will nevertheless be understood that no limitation of the scope of the present invention is thereby intended. Any alterations and further modifications in the illustrated embodiments, and any further applications of the principles of the present invention as illustrated herein are contemplated as would normally occur to one skilled in the art to which the present invention relates.

Figure 2:
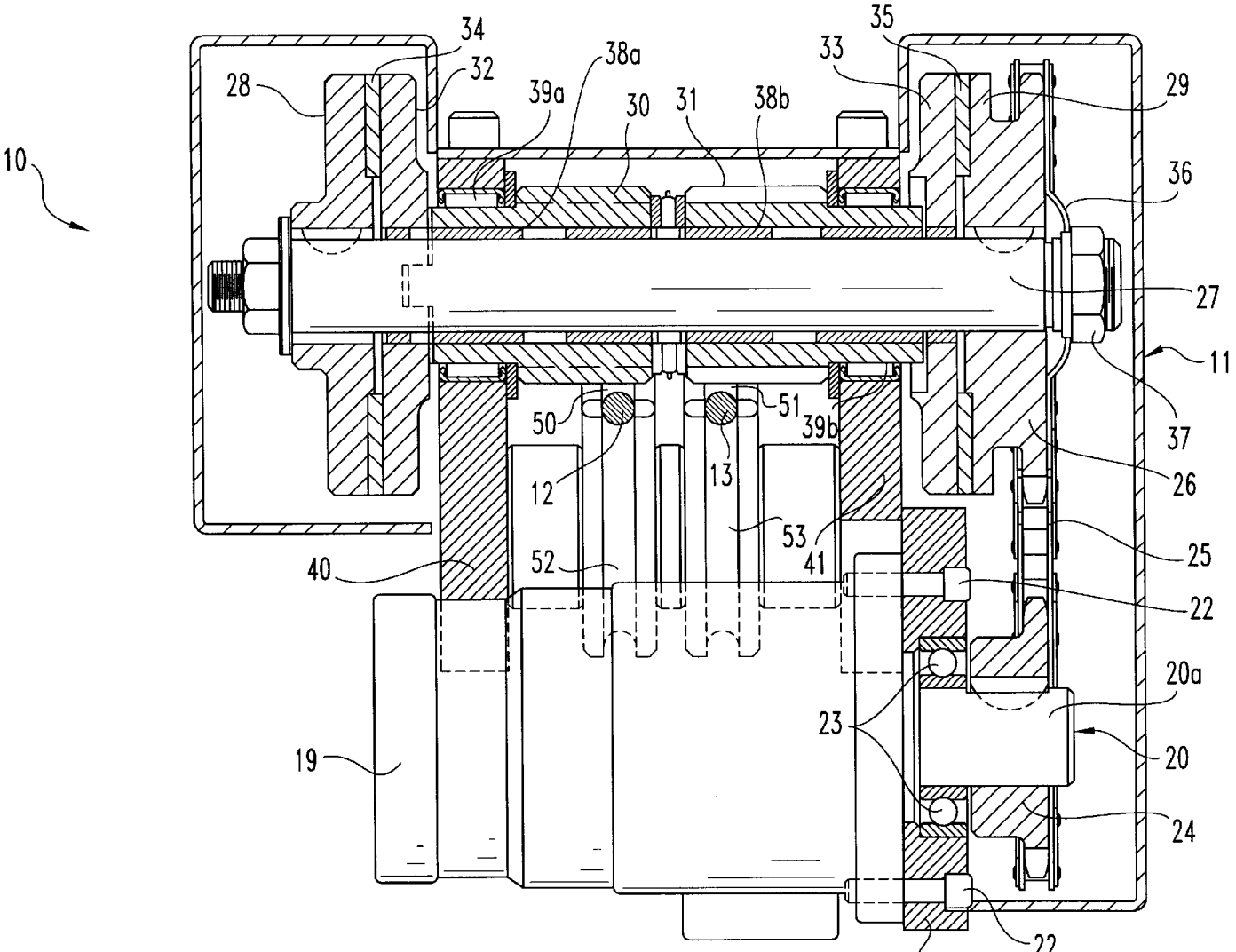
FIG. 2 is an enlarged cross sectional view taken along the line 2—2 of FIG. 1 and viewed in the direction of the arrows.
Figure 3:
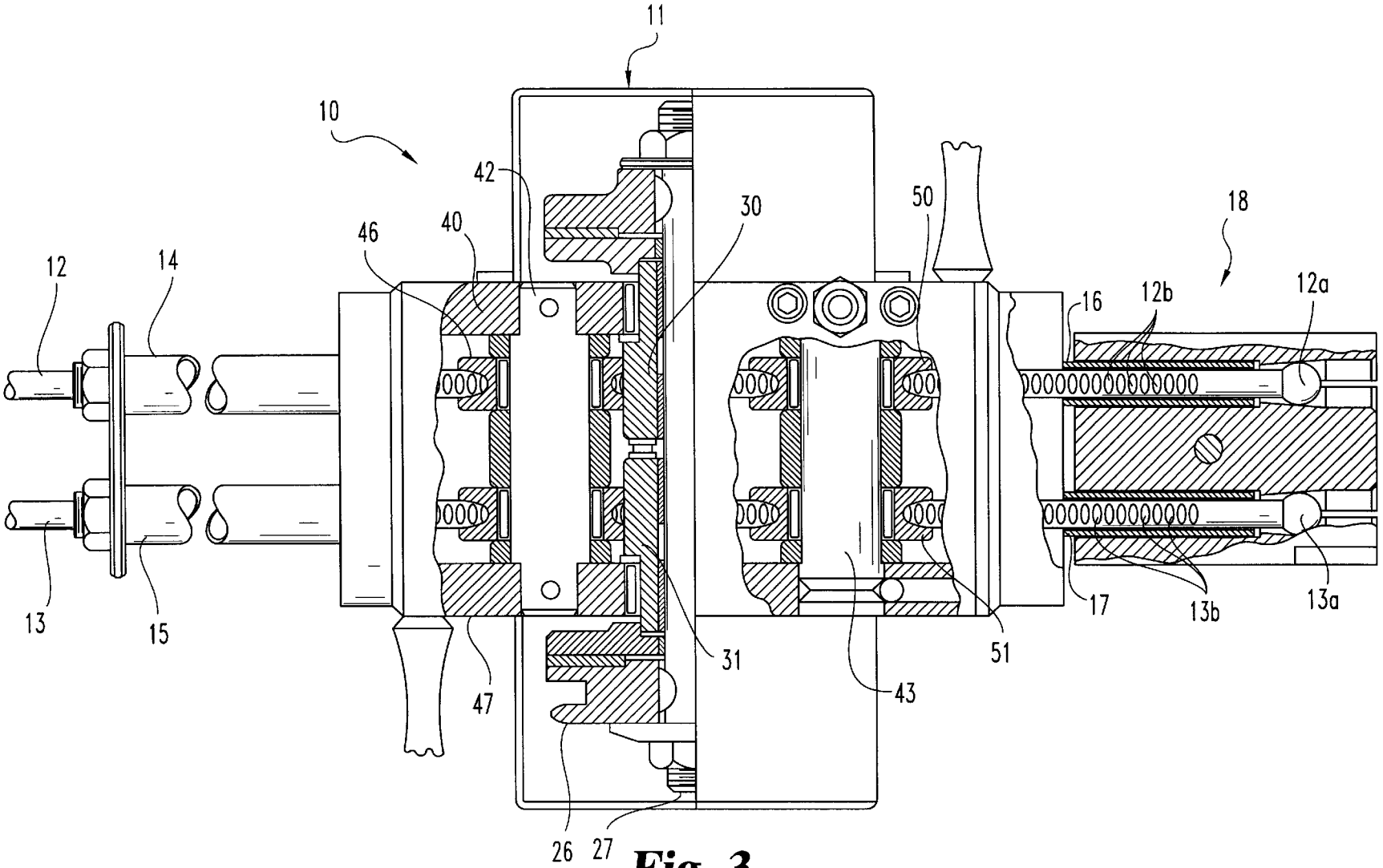
FIG. 3 is a top fragmented view of the tube expander of FIG. 1

Referring now more particularly to FIGS. 1–3, there is shown a preferred embodiment of a new and unique tube expander 10 in accordance with the present invention for expanding a plurality of tubes which longitudinally extend from a plurality of heat exchanging fins. Tube expander 10 will be described herein for simultaneously expanding a pair of tubes. However, it is to be appreciated and understood that the present invention contemplates a tube expander for expanding a single tube, or for expanding three or more tubes.

Tube expander 10 comprises a frame 11, and a pair of rods 12 and 13 slidably mounted to frame 11. The present invention contemplates that rods 12 and 13 can have any geometric configuration. The present invention further contemplates that rods 12 and 13 can be slidably mounted to frame 11 by any method. Preferably, as best shown in FIG. 3, a rod support 14 is mounted to and longitudinally extends from a rear wall of frame 11, and a conduit 16 is mounted to and longitudinally extends from a front wall of frame 11 to slidably mount rod 12 to frame 11; and a rod support 15 is mounted to and longitudinally extends from the rear wall of frame 11, and a conduit 17 is mounted to and longitudinally extends from the front wall of frame 11 to slidably mount rod 13 to frame 11. Rod 12 has a rounded distal end 12*a* (FIG. 3) to expand a tube, and a rod 13 has a rounded distal end (FIG. 3) 13*a* to expand a neighboring tube. Accordingly, tub expander 10 includes a device 18 for aligning rounded distal end 12*a* of rod 12 and rounded distal end 13*a* of rod 13 with a pair of neighboring tubes. Preferably, device 18 is an expander jaw mounted on conduits 16 and 17 as described in U.S. Pat. No. 3,789,648 to Ames, hereby incorporated by reference. Tube expander 10 further includes a mechanism for longitudinally driving rounded distal end 12*a* of rod 12 and rounded distal end 13*a* of rod 13 through device 18. The mechanism includes a power source, a first rod driver gear 46 (FIG. 3) connected to the power source and engagable with a plurality of grooves extending on an upper portion of rod 12 (a few of which are hereby designated as 12*b* in FIGS. 3 and 5A), a second rod driver gear 47 (FIG. 3) connected to the power source and engagable with a plurality of grooves extending on an upper portion of rod 13 (a few of which are hereby designated as 13*b* in FIGS. 1 and 3), a third rod driver gear 48 (FIG. 5A) engagable with a plurality of grooves extending on a lower portion of rod 12 (a few of which are hereby designated as 12*c* in FIG. 5A), a fourth rod driver gear engagable with a plurality of grooves extending on a lower portion of rod 13 (a few of which are hereby designated as 13*c* in FIG. 1), a fifth rod driver gear 50 (FIGS. 2 and 3) connected to the power source and engagable with grooves 12*b* of rod 12, a sixth rod driver gear 51 (FIGS. 2 and 3) connected to the power source and engagable with grooves 13*b* of rod 13, a seventh rod driver gear 52 (FIGS. 2 and 5A) engagable with grooves 12*c* of rod 12, and an eighth rod driver gear 53 (FIG. 2) engagable with grooves 13*c* of rod 13.

Still referring to FIGS. 1–3, the present invention contemplates that the power source can be any type of device for producing a physical force. Preferably, as best shown in FIG. 2, the power source is a hydraulic motor 19 secured to an end plate 21 of frame 11 via a bolts 22. Hydraulic motor 19 includes a rotatable drive shaft 20 extending through roller bearings 23 of end plate 21. The present invention contemplates that rod driver gears 46, 47, 50, and 51 can be connected to rotatable drive shaft 20 by any method. Preferably, a gear 24 is fixedly mounted to a distal end 20*a* of rotatable drive shaft 20 and is in meshing engagement with a continuous roller chain 25 which extends around and is in meshing engagement with a gear 26 fixedly mounted to shaft 27. Also fixedly mounted to shaft 27 are a pair of clutch drive plates 28 and 29. A pair of drive gears 30 and 31 are mounted to shaft 27 and are keyed to a pair of clutch plates 32 and 33, respectively, through which shaft 27 extends. A clutch pad 34 is held between clutch drive plate 28 and clutch plate 32, and a clutch pad 35 is held between clutch drive plate 29 and clutch plate 33. Pressure is applied to clutch pads 34 and 35 by a spring 36 which is urged against gear 26 by nut 37 threadedly received by shaft 27. Shaft 27 is rotatably received by a pair of bearings 38*a* and 38*b* positioned between gears 30 and 31, and shaft 27. Gears 30 and 31 are rotatably mounted by a pair of bearings 39*a* and 39*b* which are positioned in a pair of plates 40 and 41, respectively. A pair of shafts 42 and 43 are mounted to plates 40 and 41, and a pair of idler shafts 44 and 45 are mounted to plates 40 and 41. Rod driver gears 46 and 47 are rotatably mounted to shaft 42 and rod driver gears 50 and 51 are rotatably mounted to shaft 43. Rod driver gears 46 and 50 are in a meshing engagement with gear 30, and rod driver gears 47 and 51 are in a meshing engagement with gear 31. Thus, it is to be appreciated that any rotation of shaft 27 by hydraulic motor 20 results in a rotation of rod driver gears 46 and 47 about shaft 42 and a rotation of rod driver gears 50 and 51 about shaft 43. Rod driver gears 48 and 49 are rotatably mounted to idler shaft 44 and are in a meshing engagement with rod driver gears 46 and 47, respectively. Thus, any rotation of rod driver gears 46 and 47 about shaft 42 results in a rotation of rod driver gears 48 and 49 about idler shaft 44. Rod driver gears 52 and 53 are rotatably mounted to idler shaft 45 and are in a meshing engagement with rod driver gears 50 and 51, respectively. Thus, any rotation of rod driver gears 50 and 51 about shaft 43 results in a rotation of rod driver gears 52 and 53 about idler shaft 45.

Figure 4:
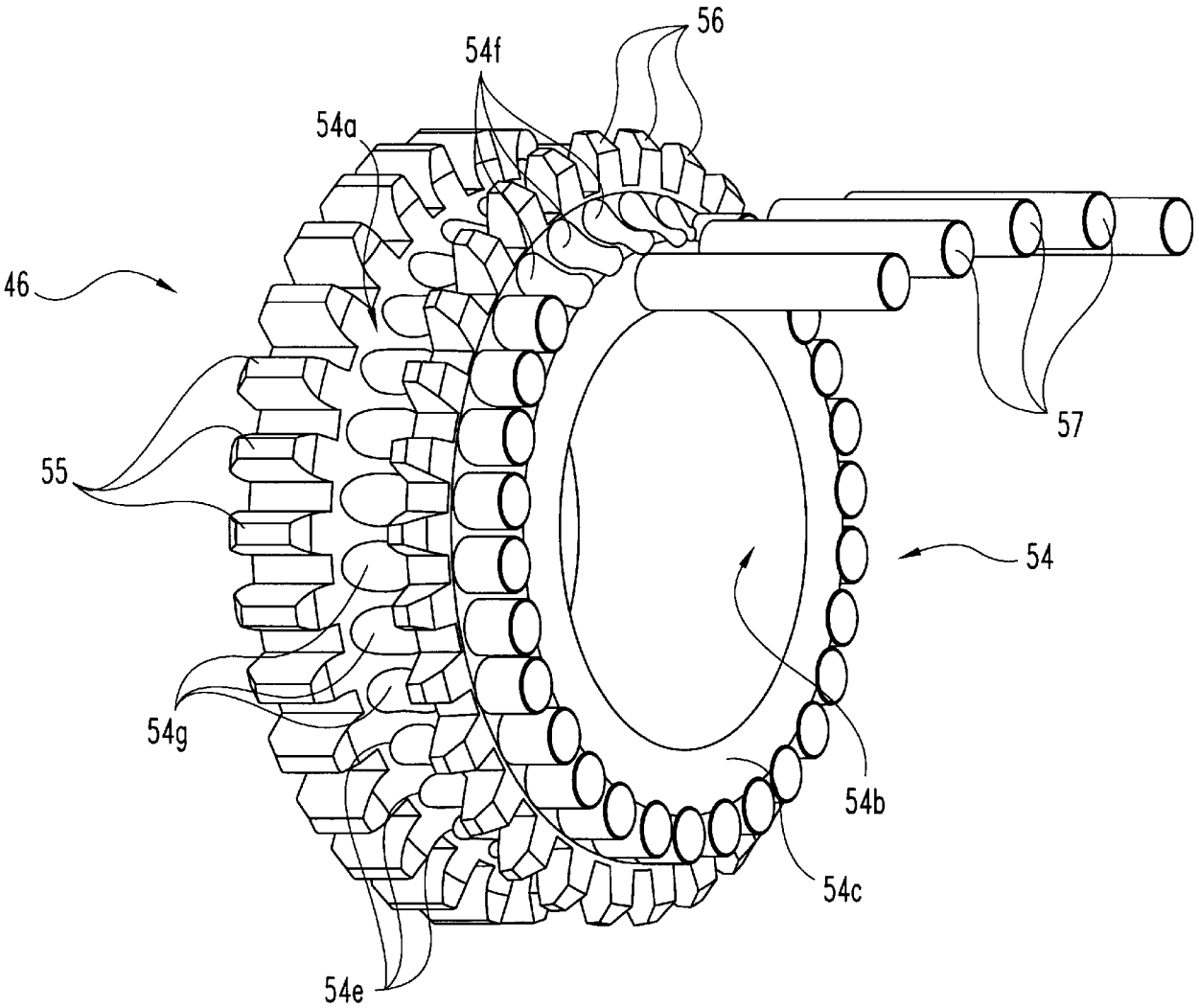
FIG. 4 is a partially exploded view of a first embodiment of a rod driver gear in accordance with the present invention.

Referring to FIG. 4, a preferred embodiment of rod driver gear 46 will now be described herein. Rod driver gear 46 comprises an annular body 54 having an outer diameter surface 54*a*, an inner diameter surface 54*b*, a first side surface 54*c*, and a second side surface. A plurality of teeth (a few of which are hereby designated as 55) are integrated to and extend from a first edge of outer diameter surface 54*a*, and a plurality of teeth (a few of which are hereby designated as 56) are integrated to and extend from a second edge of outer diameter surface 54*a* to form a continuous channel on outer diameter surface 54*a*. The present invention contemplates that the channel is geometrically configured and dimensioned to receive rod 12. Outer diameter surface 54*a* has a plurality of grooves (a few of which are hereby designated as 54*e*) extending traversely across the circumference of outer diameter surface 54*a*. First side surface 54*c* has a plurality of openings (a few of which are hereby designated as 54*f*) bored into grooves 54*e*, and a plurality of pins (a few of which are hereby designated as 57) are inserted into openings 54*f* whereby portions of pins 57 extend from grooves 54*e*. It is to be appreciated and understood that the portions of pins 57 extending from grooves 54*e* constitute a plurality of ridges (a few of which are hereby designated as 54*g*) extending traversely across the circumference of outer diameter surface 54*a*. The ridges 54*g* are dimensioned to extend into grooves 12*b* of rod 12 to engage grooves 12*b* as further described in FIGS. 5A–5B and accompanying text. It is to be appreciated and understood that the preceding description of rod driver gear 46 herein equally and correspondingly applies to rod driver gears 47–53. However, the present invention contemplates that alternative embodiments of tube expander 11 can include one ore more rod driver gears having a smooth outer diameter surface as disclosed in U.S. Pat. No. 3,789,648 to Ames.

Figure 5A:
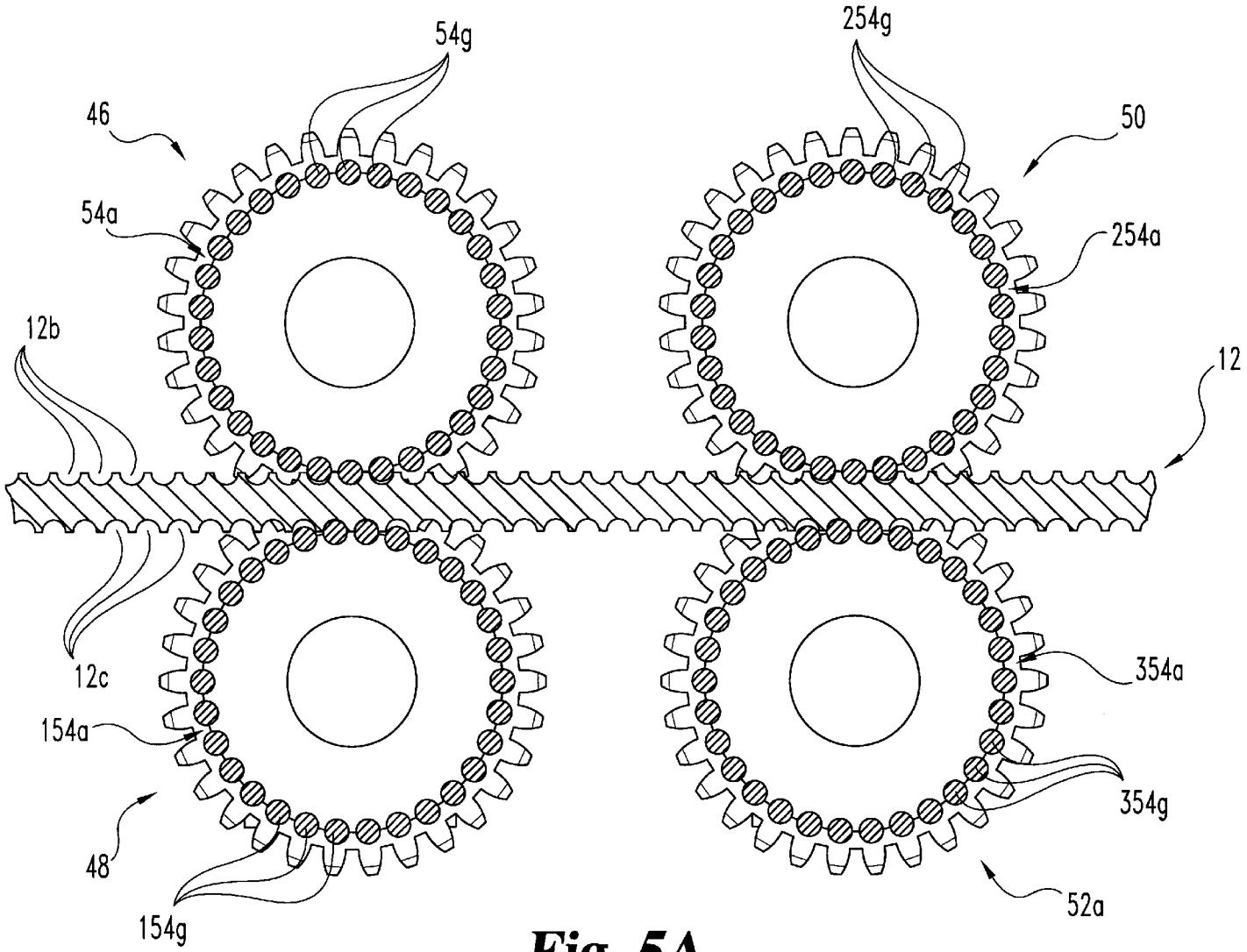
FIG. 5A is a cross-sectional side view of a rod and two pairs of rod driver gears of FIGS. 1–3.
Figure 5B:
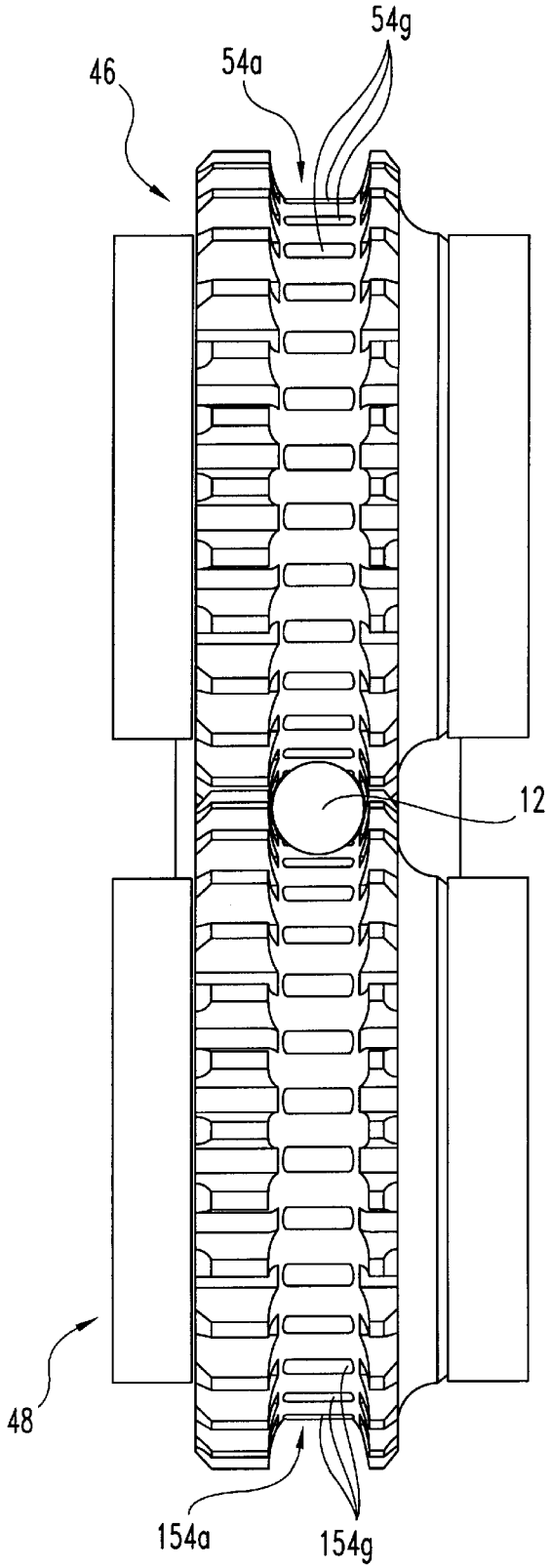
FIG. 5B is a side view of FIG. 5A.

Referring to FIGS. 5A–5B, rod 12 and rod driver gears 46, 48, 50 and 52 are shown. As best shown in FIG. 5A, ridges 54*g* of rod driver gear 46 are dimensioned to extend into grooves 12*b* of rod 12, a plurality of ridges of rod driver gear 48 (a few of which are hereby designated as 154*g*) are dimensioned to extend into grooves 12*c* of rod 12, a plurality of ridges of rod driver gear 50 (a few of which hereby are designated as 254*g*) are dimensioned to extend into grooves 12*b* of rod 12, and a plurality of ridges of rod driver gear 52 (a few of which are hereby designated as 354*g*) are dimensioned to extend into grooves 12*c* of rod 12. Thus, it is to be appreciated that any rotation of shaft 27 (FIG. 2) by hydraulic motor 20 (FIG. 2) results in a rotation of rod driver gear 46 about shaft 42 (FIG. 3) and a rotation of rod driver gear 48 about idler shaft 44 (FIG. 1) thereby sequentially engaging ridges 54*g* of rod driver gear 46 with grooves 12*b* of rod 12, and sequentially engaging ridges 154*g* of rod driver gear 48 with grooves 12*c* of rod 12. It is to be further appreciated that any rotation of shaft 27 by hydraulic motor 20 results in a rotation of rod driver gear 50 about shaft 43 (FIG. 3) and a rotation of rod driver gear 52 about idler shaft 45 (FIG. 1) thereby sequentially engaging ridges 254*g* of rod driver gear 50 with grooves 12*b* of rod 12, and sequentially engaging ridges 354*g* of rod driver gear 52 with grooves 12*c* of rod 12. Consequently, distal end 12*a* of rod 12 can be inserted into a tube and removed therefrom without rod 12 experiencing any frictional force or any dynamic pressure that may wear and tear on rod 12, and rod 12 can be minimally hardened to withstand any pressure exerted on rod 12 by a tube. As such, the present invention contemplates that outer diameter surface 54*a* of rod driver gear 46, and an outer diameter surface 154*a* of rod driver gear 48 may support rod 12 around the entire periphery of rod 12 as shown in FIG. 5B, may support rod 12 around a portion of the periphery of rod 12, or may not support rod 12. The present invention also contemplates that an outer diameter surface 254*a* of rod driver gear 50, and an outer diameter surface 354*a* of rod driver gear 52 may support rod 12 around the entire periphery of rod 12, may support rod 12 around a portion of the periphery of rod 12, or may not support rod 12. It is to be appreciated and understood that the preceding description of rod 12, and rod driver gears 46, 48, 50 and 52 herein equally and correspondingly applies to rod 13, and rod driver gears 47, 49, 51, and 53.

Figure 6:
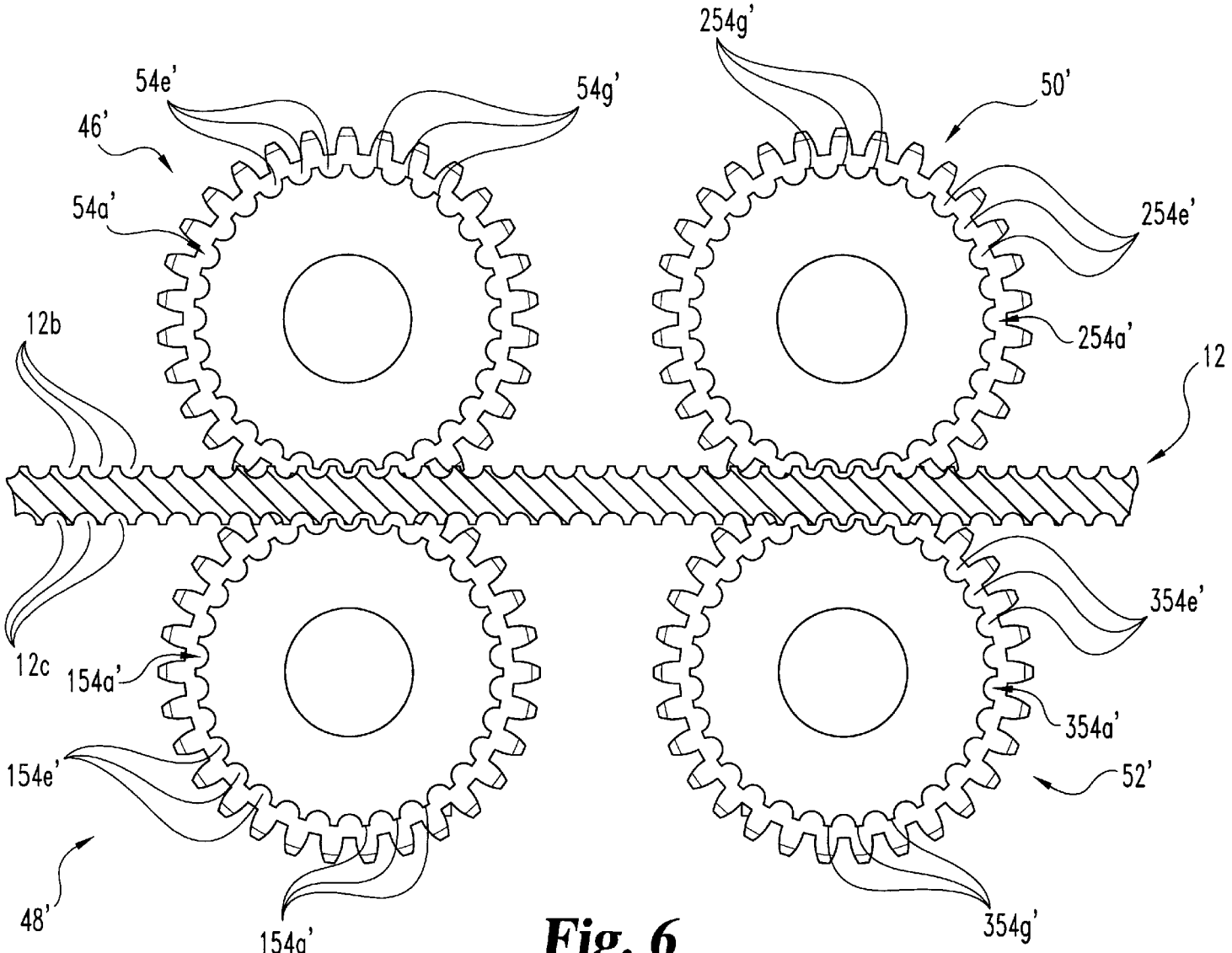
FIG. 6 is a cross-sectional side view an alternative embodiment of a rod and two pairs of rod driver gears in accordance with the present invention.

Referring to FIG. 6, rod 12, and rod driver gears 46', 48', 50' and 52' are shown. Rod driver gears 46', 48', 50' and 52' are modification of rod driver gears 46, 48, 50 and 52, respectively, without the pins. It is to be appreciated that grooves of rod driver gear 46' (a few of which are hereby designated as 54*e*') define a plurality of ridges extending traversely across the circumference of an outer diameter surface 54*a*' of rod driver gear 46' (a few of which are hereby designated as 54*g*') dimensioned to extend into grooves 12*b* of rod 12, a plurality of grooves of rod driver gear 48' (a few of which are hereby designated as 154*e*') define a plurality of ridges extending traversely across the circumference of an outer diameter surface 154*a*' of rod driver gear 48' (a few of which are hereby designated as 154*g*') and dimensioned to extend into grooves 12*c* of rod 12, a plurality of grooves of rod driver gear 50' (a few of which are hereby designated as 254*e*') define a plurality of ridges extending traversely across the circumference of an outer diameter surface 254*a*' of rod driver gear 50' (a few of which are hereby designated as 254*g*') and dimensioned to extend into grooves 12*b* of rod 12, and a plurality of grooves of rod driver gear 52' (a few of which are hereby designated as 354*e*') define a plurality of ridges extending traversely across the circumference of an outer diameter surface 354*a*' of rod driver gear 52' (a few of which are hereby designated as 354*g*') and dimensioned to extend into grooves 12*c* of rod 12. Thus, it is to be appreciated that any rotation of shaft 27 (FIG. 2) by hydraulic motor 20 (FIG. 2) results in a rotation of rod driver gear 46' about shaft 42 (FIG. 3) and a rotation of rod driver gear 48' about idler shaft 44 (FIG. 1) thereby sequentially engaging ridges 54*g*' of rod driver gear 46' with grooves 12*b* of rod 12, and sequentially engaging ridges 154*g*' of rod driver gear 48' with grooves 12*c* of rod 12. It is to be further appreciated that any rotation of shaft 27 by hydraulic motor 20 results in a rotation of rod driver gear 50' about shaft 43 (FIG. 3) and a rotation of rod driver gears 52' about idler shaft 45 (FIG. 1) thereby sequentially engaging ridges 254*g*' of rod driver gear 50' with grooves 12*b* of rod 12, and sequentially engaging ridges 354*g*' of rod driver gear 52' with grooves 12*c* of rod 12. Consequently, as with rod driver gears, 46', 48', 50' and 52', distal end 12*a* of rod 12 can be inserted into a tube and removed therefrom without rod 12 experiencing any frictional force or dynamic pressure that may wear and tear on rod 12, and rod 12 can be minimally hardened to withstand any pressure exerted on rod 12 by a tube. As such, the present invention contemplates that outer diameter surface 54*a*' of rod driver gear 46', and outer diameter surface 154*a*' of rod driver gear 48' may support rod 12 around the entire periphery of rod 12, may support rod 12 around a portion of the periphery of rod 12, or may not support rod 12, and outer diameter surface 254*a*' of rod driver gear 50', and a concave outer diameter surface 354*a*' of rod driver gear 52' may support rod 12 around the entire periphery of rod 12, may support rod 12 around a portion of the periphery of rod 12, or may not support rod 12. It is to be appreciated and understood that the preceding modified description of rod driver gears 46, 48, 50 and 52 herein equally and correspondingly applies to rod driver gears 47, 49, 51, and 53.

While the present invention has been illustrated and described in detail in the drawings and foregoing description, the same is to be considered as illustrative and not restrictive in character, it being understood that the preferred embodiments have been shown and described and that all changes and modifications that come within the spirit of the invention are desired to be protected.

What is claimed is:

1. A tool for expanding a tube comprising:

a frame;

a rod having a longitudinal axis and a circumferentially extending outer surface with a plurality of grooves thereon extending traversely across said longitudinal axis, said rod further having a rounded distal end, said rod being slidably mounted to said frame along said longitudinal axis; correspond shaped a power source; and a rod driver gear including an annular body rotatably mounted to said frame and connected to said power source, said annular body having an outer diameter surface and a plurality of ridges extending across said outer diameter surface and dimensioned to extend into said grooves of said rod, wherein said plurality of ridges sequentially engage said grooves of said rod as said power source rotates said annular body to move said rod along said longitudinal axis of said rod, whereby the tube can be expanded upon an insertion of said rod within the tube.

2. The tool of claim 1 wherein said annular body further has a side surface bordering said outer diameter surface, a plurality of grooves extending across said outer diameter surface, and a plurality of openings bored through said side surface into said grooves; and wherein said rod driver gear further includes a plurality of pins, each pin of said plurality of pins inserted within a separate opening of said plurality of openings, a portion of each pin extending through said corresponding groove to constitute said plurality of ridges.

3. The tool of claim 1 wherein said annular body further has a plurality of grooves extending across said outer diameter surface to constitute said ridges.

4. A tool for expanding a tube comprising:

a frame;

a rod having a longitudinal axis and a circumferentially extending outer surface with a plurality of grooves thereon extending traversely across said longitudinal axis, said rod further having a rounded distal end, said rod being slidably mounted to said frame along said longitudinal axis;

a power source; and a rod driver gear including an annular body rotatably mounted to said frame and connected to said power source, said annular body having an outer diameter surface, said outer diameter surface having a continuous channel formed thereon, and a means disposed within said continuous channel for sequentially engaging said grooves of said rod as said power source rotates said annular body to move said rod along said longitudinal axis of said rod, whereby the tube can be expanded upon an insertion of said rod within the tube.

5. A device for expanding a tube comprising:

a frame;

a first rod slidably mounted to said frame and including a distal end for entering and expanding a tube as the rod is moved therethrough, said rod including an outer rounded surface with a plurality of first grooves extending transversely thereacross;

a first wheel rotatably mounted to said frame about an axis of rotation, said wheel including an outer circumferentially extending surface with a continuous channel formed thereon and extending around said axis, said channel including a plurality of ridges extending transversely thereacross, said circumferentially extending surface contacting said rounded surface and said ridges extending into said grooves as said wheel is rotated to cooperatively drive said rod into and out of said tube.

6. The device of claim 5 and further comprising:

a second wheel rotatably mounted to said frame about a second axis of rotation, said second wheel including an outer circumferentially extending second surface with a continuous second channel formed thereon and extending around said second axis, said second channel including a plurality of second ridges extending transversely thereacross, said circumferentially extending second surface contacting said rounded surface and said second ridges extending into said grooves as said second wheel is rotated to cooperatively drive said rod into and out of said tube.

7. The device of claim 6 wherein:

said first wheel and said second wheel include a plurality of pins extending into said first channel and said second channel forming said first ridges and said second ridges.

8. The device of claim 6 wherein:

said first rod includes a first side and an opposite second side and further includes a plurality of second grooves extending transversely thereacross with said first grooves and said second grooves being located respectively on said first side and said second side; and, said first wheel is positioned on said first side of said rod and said second wheel is positioned on said second side of said rod.

9. The device of claim 6 wherein:

first wheel and said second wheel are on the same side of said rod.

10. The device of claim 5 and further comprising:

a second rod slidably mounted to said frame and including a distal end for entering and expanding a tube as the second rod is moved therethrough, said second rod including an outer rounded second surface with a plurality of second grooves extending transversely thereacross;

a second wheel rotatably mounted to said frame about a second axis of rotation, said second wheel including an outer circumferentially extending second surface with a continuous second channel formed thereon and extending around said second axis, said second channel including a plurality of second ridges extending transversely thereacross, said circumferentially extending second surface contacting said second rounded surface and said second ridges extending into said second grooves as said second wheel is rotated to cooperatively drive said second rod into and out of a tube.

* * * * *